United States Patent [19]

Gattuso

[11] 3,930,810

[45] Jan. 6, 1976

[54] ADDITIVES FOR PETROLEUM DISTILLATES

[75] Inventor: Marion J. Gattuso, Hoffman Estates, Ill.

[73] Assignee: Universal Oil Products Company, Des Plaines, Ill.

[22] Filed: July 31, 1974

[21] Appl. No.: 493,377

[52] U.S. Cl. ..... 44/56; 44/58; 44/72; 44/DIG. 1; 252/392; 44/62

[51] Int. Cl.[2] ..... C10L 1/22

[58] Field of Search ..... 44/72, 56, DIG. 1, 58, 44/62, 77; 252/392

[56] References Cited

UNITED STATES PATENTS

| | | | |
|---|---|---|---|
| 3,030,939 | 4/1962 | Brandt et al. | 44/77 |
| 3,294,499 | 12/1966 | Brook et al. | 44/77 |
| 3,598,553 | 8/1971 | Rosenwald | 44/DIG. 1 |
| 3,653,853 | 4/1972 | Rosenwald | 44/DIG. 1 |
| 3,686,315 | 8/1972 | Rosenwald | 44/72 |
| 3,756,795 | 9/1973 | Rosenwald | 44/DIG. 1 |

*Primary Examiner*—Daniel E. Wyman
*Assistant Examiner*—Y. Harris-Smith
*Attorney, Agent, or Firm*—James R. Hoatson, Jr.; Raymond H. Nelson; William H. Page, II

[57] ABSTRACT

Additive formulations for use in petroleum distillates such as gasoline which provide improved properties will comprise a mixture of a solution of the polymeric reaction product between an epihalohydrin and an N-alkyl polyamine in an aromatic solvent, a solution of the polymeric reaction product of an epihalohydrin and a primary amine in an aromatic solvent, a lower molecular weight alcohol and a demulsifier.

12 Claims, No Drawings

ADDITIVES FOR PETROLEUM DISTILLATES

This invention relates to additive formulations for use in petroleum distillates. More particularly the invention is concerned with additive formulations for use in petroleum distillates such as gasoline whereby said distillate will possess advantageous physical properties.

Petroleum distillates such as gasoline, naphtha, fuel oils, diesel oils, jet fuel, kerosene, lubricating oils, cutting oils, soluble oils, slushing oils, rolling oils, which may be of mineral, animal or vegetable origin, etc., will tend, during storage or in use, to undergo deterioration with the concurrent formation of sediment, undesirable discoloration, etc., or pick up water. The formation of sediment is objectionable due to the fact that sediment tends to plug strainers, burner tips, injectors, etc. The presence of water in petroleum distillates such as gasoline is disadvantageous inasmuch as the engine of an automobile, bus, truck, etc., may stall due to the formation of ice in the fuel lines. It is also well known in the art that, at temperatures ranging from about 30° to about 60° F. and at periods of relatively high humidities, such stalling has been encountered under idling or low load conditions. This stalling is caused by the airborne moisture undergoing freezing due to the refrigerating effect which is encountered in normal fuel vaporization within the carburetor. The ice is formed on the throttle plate and adjacent carburetor walls thereby restricting the narrow air openings and causing the engine to stall. This icing problem is of increasing importance because of the design of newer automobiles. For example, for many years automobiles have not been equipped with a manual throttle and therefore the operator of the car no longer is able to increase the idling speed during the warm-up period to prevent such stalling. Furthermore, the use of automatic transmissions adds to the problem inasmuch as the idle speed must be kept relatively low to avoid creeping and, accordingly, the idle speed is not sufficiently fast to avoid stalling due to icing. Still another development which appears to add to this problem is the increased volatility of commercial gasolines, because more frequent stalling is encountered with the more volatile fuels.

In this respect, it has now been discovered that an additive may be prepared which, when used in petroleum distillates such as gasoline, either leaded or unleaded, will protect against icing stalls and, in addition, will also protect against rust and corrosion. This anti-rust protection will reduce any deposits which may form in the fuel tank, fuel lines, etc. Furthermore, the formulation of the present invention will provide improved water interaction properties and has been found to be unique in its ability to improve water shedding properties of a fuel which contains only a carburetor detergent and de-icer combination.

It is therefore an object of this invention to provide an additive for petroleum distillates which will protect said distillates against deterioration.

A further object of this invention is to provide an additive formulation for petroleum distillates whereby certain physical properties will possess enhanced values.

In one aspect an embodiment of this invention resides in an additive formulation for petroleum distillates which comprises from about 50% to about 90% by weight of a solution of the polymeric reaction product of an epihalohydrin and an N-alkylpolyamine in an aromatic solvent, from about 10% to about 50% by weight of a solution of the polymeric reaction product of an epihalohydrin and a primary amine in an aromatic solvent, from about 1% to about 10% by weight of a lower molecular weight alcohol and from about 1% to about 10% by weight of an oil demulsifier.

A specific embodiment of this invention is found in an additive formulation for petroleum distillates which comprises from about 50% to about 90% by weight of a solution of the polymeric reaction product of epichlorohydrin and N-tallow-1,3-propanediamine in an aromatic solvent, from about 10% to about 50% by weight of a solution of the polymeric reaction product of epichlorohydrin and hydrogenated tallow amine in an aromatic solvent, from about 1% to about 10% by weight of isopropyl alcohol and from about 1% to about 10% by weight of an oil demulsifier.

Other objects and embodiments will be found in the following further detailed description of the present invention.

As hereinbefore set forth the present invention is concerned with additive formulations which, when added to petroleum distillates, will provide certain beneficial effects such as maintaining the cleanliness of engine parts, protect against icing, stalling, provide anti-rust protection by acting as a corrosion inhibitor, function as a fuel oil stabilizer-dispersant, etc., the importance of preventing stalling in automotive engines being of primary importance. In addition, when utilizing the additive formulation of the present invention, the petroleum distillate such as gasoline, fuel oil, etc., will be protected during storage and, in addition, the equipment which is necessary for handling said petroleum distillate during production, storage and use will be protected against rust and corrosion.

The additive formulation of the present invention consists of 4 components, namely, (1) a solution of the polymeric reaction product resulting from the reaction between an epihalohydrin and an N-alkylpolyamine in an aromatic solvent; (2) a solution of the polymeric reaction product of an epihalohydrin and a primary amine in an aromatic solvent; (3) a lower molecular weight alcohol and (4) an oil demulsifier. The first component which is present in the additive formulation, namely, the polymeric reaction product of an epihalohydrin and an N-alkylpolyamine is prepared by effecting the reaction at temperatures ranging from about 20° to about 100° C. The N-alkylpolyamine which is reacted with the epihalohydrin preferably comprises N-alkyl-1,3-diaminopropanes in which the alkyl group contains at least 12 carbon atoms and a straight chain of at least 3 carbon atoms attached to the nitrogen atom. Illustrative examples include N-dodecyl-1,3-diaminopropane, N-tridecyl-1,3-diaminopropane, N-tetradecyl-1,3-diaminopropane, N-pentadecyl-1,3-diaminopropane, N-hexadecyl-1,3-diaminopropane, N-heptadecyl-1,3-diaminopropane, N-octadecyl-1,3-diaminopropane, N-nonadecyl-1,3-diaminopropane, N-eicosyl-1,3-diaminopropane, N-heneicosyl-1,3-diaminopropane, N-docosyl-1,3-diaminopropane, N-tricosyl-1,3-diaminopropane, N-tetracosyl-1,3-diaminopropane, N-pentacosyl-1,3-diaminopropane, N-hexacosyl-1,3-diaminopropane, N-heptacosyl-1,3-diaminopropane, N-octacosyl-1,3-diaminopropane, N-nonacosyl-1,3-diaminopropane, N-triacontyl-1,3-diaminopropane, N-hentriacontyl-1,3-diaminopropane, N-dotriacontyl-1,3-diaminopropane, N-tritriacontyl-1,3-diaminopropane, N-tetratriacontyl-1,3-diaminopropane, N-pentatriacontyl-1,3-diaminopropane, N-hexatriacontyl-1,3-diaminopropane, N-heptatriacontyl-1,3-diaminopropane, N-octatriacontyl-1,3-diaminopropane, N-nonatriacontyl-1,3-diaminopropane, N-tetracontyl-1,3-diaminopropane, etc. As before mixtures are available commercially, usually at lower prices, of suitable compounds of this class and advantageously are used for the purposes of the present invention. One such mixture is "Kemamine D-970" which is N-hydrogenated-tallow-1,3-diaminopropane and predominates in alkyl groups containing from 16 to 18 carbon atoms each, although the mixture contains a small amount of alkyl groups containing 14 carbon atoms each. Another mixture available commercially is N-coco-1,3-diaminopropane which contains alkyl groups predominating in 12 to 14 carbon atoms each. Il While the N-alkyl-1,3-diaminopropanes are preferred compounds of this class, it is understood that suitable N-alkyl ethylene diamines, N-alkyl-1,3-diaminobutanes, N-alkyl-1,4-diaminobutanes, N-alkyl-1,3-diaminopentanes, N-alkyl-1,4-diaminopentanes, N-alkyl-1,5-diaminopentanes, N-alkyl-1,3-diaminohexanes, N-alkyl-1,4-diaminohexanes, N-alkyl-1,5-diaminohexanes, N-alkyl-1,6-diaminohexanes, etc. may be employed, but not necessarily with equivalent results. Also, it is understood that polyamines containing three or more nitrogen atoms may be employed provided they meet the requirements hereinbefore set forth. Illustrative examples of such compounds include n-dodecyl-diethylene triamine, N-tridecyl-diethylene triamine, N-tetradecyldiethylene triamine, etc., N-dodecyl-dipropylene triamine, N-tridecyldipropylene triamine, N-tetradecyl-dipropylene triamine, etc., N-dodecyldibutylene triamine, N-tridecyl-dibutylene triamine, N-tetradecyl-dibutylene triamine, etc., N-dodecyl-triethylene tetramine, N-tridecyl-triethylene tetramine, N-tetradecyl-triethylene tetramine, etc., N-dodecyl-tripropylene tetramine, N-tridecyl-tripropylene tetramine, N-tetradecyl-tripropylene tetramine, etc., N-dodecyl-tributylene tetramine, N-tridecyl-tributylene tetramine, N-tetradecyl-tributylene tetramine, etc., N-dodecyl-tetraethylene pentamine, N-tridecyl-tetraethylene pentamine, N-tetradecyl-tetraethylene pentamine, etc., N-dodecyl-tetrapropylene pentamine, N-tridecyl-tetrapropylene pentamine, N-tetradecyl-tetrapropylene pentamine, etc., N-dodecyl-tetrabutylene pentamine, N-tridecyl-tetrabutylene pentamine, N-tetradecyltetrabutylene pentamine, etc.

In another embodiment, polyaminoalkanes meeting the requirements hereinbefore set forth may be employed but generally such materials are not available commercially and, therefore, generally are not preferred. Illustrative examples of such compounds include 1,12-diaminododecane, 1,13-diaminotridecane, 1,14-diaminotetradecane, etc.

In general, unsaturated compounds may be employed, provided they meet the other requirements hereinbefore set forth. Such amine compounds may be prepared from unsaturated fatty acids and, therefore, may be available commercially at lower cost. Illustrative examples of such amine compounds include dodecylenyl amine, N-dodecylenyl ethylene diamine, N-dodecylenyl-1,3-diaminopropane, oleyl amine, N-oleyl ethylene diamine, N-oleyl-1,3-diaminopropane, linoleyl amine, N-linoleyl ethylene diamine, N-linoleyl-1,3-diaminopropane, etc. Mixtures are commercially available which contain predominantly unsaturated carbon chains, and one such mixture is "Duomeen O" which is N-oleyl-1,3-diaminopropane in which the unsaturated $C_{18}$ chain is the main constituent. In addition, mixtures of alkyl and alkenyl amines may also be employed. One such mixture is "Duomeen T" which is a mixture of N-substituted 1,3-diaminopropanes in which the carbon chain consists of saturated and unsaturated groups containing 16 to 18 carbon atoms. It is understood that these amine compounds are included in the present specifications and claims by reference to amine or amine compounds.

As hereinbefore set forth, the amine compound is reacted with an epihalohydrin compound. Epichlorohydrin is preferred. Other epichlorohydrin compounds include 1,2-epoxy-4-chlorobutane, 2,3-epoxy-4-chlorobutane, 1,2-epoxy-5-chloropentane, 2,3-epoxy-5-chloropentane, etc. In general, the chloro derivatives are preferred, although it is understood that the corresponding bromo and iodo compounds may be employed. In some cases epidihalohydrin compounds may be utilized. It is understood that the different epihalohydrin compounds are not necessarily equivalent in the same or different substrate and that, as hereinbefore set forth, epichlorohydrin is preferred.

In general, one or two moles of amine compound is reacted with one or two moles of epihalohydrin compound. It is understood that, in some cases, an excess of amine or of epihalohydrin may be supplied to the reaction zone in order to ensure complete reaction, the excess being removed subsequently in any suitable manner. When two moles of amine are reacted per mole of epihalohydrin compound, the amine may comprise the same or different amine compound.

The desired quantity of alkylamine and epihalohydrin compounds may be supplied to the reaction zone and therein reacted, although generally it is preferred to supply one reactant to the reaction zone and then introduce the other reactant step-wise. Thus, usually it is preferred to supply the alkylamine to the reaction zone and to add the epihalohydrin compound stepwise, with stirring. When it is desired to react two different alkylamines with the epihalohydrin compound, one of the amines is supplied to the reaction zone, the epihalohydrin compound added gradually, and the reaction completed, followed by the addition of the second alkylamine. Generally, it is preferred to utilize a solvent and, in the preferred embodiment, a solution of the alkylamine in a solvent and a separate solution of the epihalohydrin compound in a solvent are prepared, and these solutions are then commingled in the manner hereinbefore set forth. Any suitable solvent may be employed, a particularly suitable solvent comprising an alcohol including ethanol, propanol, butanol, etc., 2-propanol being particularly desirable. Other solvents such as those of the aromatic type as benzene, toluene, xylenes, etc., are also desirable.

As hereinbefore set forth the reaction is effected at temperatures which generally will be within the range of from about 20° to about 100° C. and preferably within the range of from about 50° to about 75° C. If so desired, higher reaction temperatures ranging from about 30° to about 150° C. or more and preferably of from about 50° to about 100° C. may be employed if the reaction is effected at superatmospheric pressures, the combination of superatmospheric pressures and elevated temperatures increasing the reaction velocity.

Either before or after removal of the reaction product from the reaction zone, the product is treated to remove the halogen, generally in the form of an inorganic halide salt as, for example, the hydrogen halide salt. This may be effected in any suitable manner and may be accomplished by reacting the product with a strong inorganic base such as sodium hydroxide, potassium hydroxide, etc., to form the corresponding metal halide, the removal of the halogen being effected at substantially the same conditions as were employed in the reaction between the alkylamine and the epihalohydrin. Upon completion of this reaction the metal halide is removed in any suitable manner such as by filtration, centrifugal separation, etc. In addition, it is to be understood that the reaction product is also heated to a sufficient temperature to remove alcohol and water, the removal of said alcohol and water being effected either before or after the treatment to remove the inorganic halide. The reaction product is thus present in a typical case as a 50 wt. % solution in an aromatic solvent.

The second component of the additive formulation will comprise the polymeric reaction product of an epihalohydrin and a primary amine. Illustrative examples of primary alkylamines in which the alkyl portion contains at least 12 carbon atoms include dodecyl amine, tridecyl amine, tetradecyl amine, pentadecyl amine, hexadecyl amine, heptadecyl amine, octadecyl amine, nonadecyl amine, eicosyl amine, heneicosyl amine, docosyl amine, tricosyl amine, tetracosyl amine, pentacosyl amine, hexacosyl amine, heptacosyl amine, octacosyl amine, nonacosyl amine, triacontyl amine, hentriacontyl amine, dotriacontyl amine, tritriacontyl amine, tetratriacontyl amine, pentatriacontyl amine, hexatriacontyl amine, heptatriacontyl amine, octatriacontyl amine, nonatriacontyl amine, tetracontyl amine, etc. Conveniently, the long chain amines are prepared from fatty acids or more particularly mixtures of fatty acids formed as products or by-products. Such mixtures are available commercially, generally at lower prices and, as another advantage of the present invention, the mixtures may be used without the necessity of separating individual amines in pure state.

An example of such a mixture is hydrogenated tallow amine which is available under various trade names including "Alamine H26D" and "Armeen HTD." These products comprise mixtures predominating in alkylamines containing 16 to 18 carbon atoms per alkyl group, although they contain a small amount of alkyl groups having 14 carbon atoms, and also meet the other requirements hereinbefore set forth.

It is also contemplated that the primary amine may also consist of an unsaturated material; the amine compounds being prepared, if so desired, from unsaturated fatty acids. Illustrative examples of such amine compounds include dodecylenyl amine, oleyl amine, linoleyl amine, etc. Mixtures are commercially available which contain predominantly unsaturated carbon chains, and one such mixture is "Armeen O." In addition, mixtures of alkyl and alkenyl amines may also be employed. One such mixture is "Armeen T" which is a mixture of primary amines in which the carbon chain consists of saturated and unsaturated groups containing 16 to 18 carbon atoms.

The epihalohydrin compound which is reacted with the aforementioned alkylamines will be selected from the same group which was hereinbefore set forth in the discussion relating to the reaction between the N-alkylpolyamine and the epihalohydrin. In addition, the same method of preparation and same reaction conditions of temperature and pressure are also employed in the formation of this polymeric reaction product, which upon product work-up is typically present as a 50 wt. % solution in an aromatic solvent.

The third component of the additive formulation of the present invention comprises a lower molecular weight alcohol which contains from 1 to about 5 carbon atoms, some specific illustrative examples of these alcohols being methyl alcohol, ethyl alcohol, n-propyl alcohol, isopropyl alcohol, n-butyl alcohol, sec-butyl alcohol, t-butyl alcohol, n-amyl alcohol, sec-amyl alcohol, etc.

The fourth component of the additive formulation of the present invention will comprise an oil demulsifier. In the preferred embodiment of the invention the demulsifier which is used comprises a copolymer of ethylene oxide and propylene oxide, these compounds being polymerized in such a manner so that the molecular weight of the oil demulsifier will be about 4000. A specific type of demulsifier which is employed in the additive formulation of the present invention is sold under the trade name Tretolite R-77 sold by the Petrolite Company.

The components of the additive formulation of the present invention are admixed by any means known in the art such as stirring, agitation, etc., and will be present in the formulation in such a manner so that the solution of the polymeric reaction product of an epihalohydrin and an N-alkylpolyamine in an aromatic solvent is present in an amount in the range of from about 50% to about 90% by weight, the solution of the polymeric reaction product between an epihalohydrin and a primary amine in an aromatic solvent is present in an amount in the range of from about 10 to about 50 wt. %, the lower molecular weight alcohol is present in an amount in the range of from about 1 to about 10 wt. % and the demulsifier is present in a range of from about 1 to about 10 wt. %.

In general, the additive formulation will be present in the petroleum distillate in an amount in the range of from about 10 to about 1,000 ppm. by weight of the petroleum distillate, although it is contemplated within the scope of this invention that lesser or greater amounts of the formulation may be present, the specific amount being dependent upon the particular petroleum distillate which acts as the substrate for the formulation. As will hereinafter be shown in the appended examples, the presence of the additive formulation in the petroleum distillate will provide improved activity in carburetor detergency, de-icing activity, improved water interaction properties, over the petroleum distillates which do not contain the additive formulation of the present invention.

The following examples are given to illustrate the additive formulations of the present invention and the ability of the same to provide improved properties to petroleum distillates. However, these examples are not intended to limit the generally broad scope of the present invention in strict accordance therewith.

EXAMPLE I

As an illustration of the improved water interaction properties of the additive formulations of the present invention when used in gasoline, a series of experiments were performed using a water emulsibility test method as developed by Union Oil Company. The test method which was used comprised adding approximately 600 cc. of gasoline to a mixing vessel, following which exactly 6 cc. of distilled water is then pipetted into the gasoline. The water and gasoline are then stirred for a period of exactly 10 minutes utilizing a stopwatch which is started with water addition. At the end of the 10-minute period, the stopwatch is quickly set to zero and started to that all subsequent times are measured from the moment that stirring is stopped.

A siphon tube is then placed into the liquid and clamped into such a position which has been preset to siphon the correct volume. At exactly 30 seconds from the time that stirring is stopped, the siphon is started using a suction bulb and 450 cc. of the gasoline-water mixture is transferred to a settling vessel. The settling vessel is provided at the lower end thereof with a 15 cc. calibrated centrifuge tube. The siphon tube is then removed and a loose stopper is placed on the settling vessel. The volume of water which has dropped to the bottom of the settling vessel is recorded at intervals of 1.5 minutes, 2 minutes and at each minute thereafter through 10 minutes. Following this the volume of water is further recorded at intervals of 15, 20, 30, 60, 90 and 120 minutes. After the fuel has reached the clear point, any water drops which remain on the walls of the settling tube are loosened by use of a rubber policeman and a final water volume is read.

Additional quantitative data which may be taken include a time for the gasoline to reach a light haze point and a clear point. Also the percents by volume of water phase that is emulsion is recorded at each water volume reading through the 2-hour period. The light haze point is defined as the time when two parallel red lines on a white card which are observed horizontally through the gasoline can first be resolved as two separate lines. These two lines are from 0.3 to 0.5 mm. thick and are separated by a distance of 0.3 to 0.5 mm. The card containing these lines is held at the bottom of the main point of the settling vessel just above the shoulder of the vessel. The clear point is the time at which the gasoline first reaches a bright and clear condition. This point is best judged by looking vertically down into the vessel. Observation of both the light haze and the clear point are made each 15 minutes following 30 minutes and beyond 120 minutes as necessary to catch the points.

The water emulsibility rating which is set forth in the following table is calculated from the following equation:

$$\text{Emulsibility Rating} = D_1 + D_2 - T_1 - T_2 - E + 400$$

$D_1$ = Percent by volume of water which drops out in 30 seconds $D_2$ = Percent by volume of water which drops out in 10 minutes $T_1$ = Minutes for gasoline to reach the light haze point $T_2$ = Minutes for gasoline to clear $E$ = Percent by volume of water layer in the settling vessel that is emulsion after 2 hours of settling The constant of 400 is added to give positive ratings for any additives.

Normally, the emulsion, if present, is a clearly recognized fraction of the water layer. If the water is cloudy, it is considered to be 20% emulsion; very cloudy water is considered to be 100% emulsion.

In the table below the results of four different tests are reported. Test A was run with gasoline which contained no additives. Test B was run with a sample of gasoline which contained 34 ppm. of an additive comprising 75% of a 50 wt. % solution of the polymeric reaction product between epichlorohydrin and N-tallow-1,3-diaminopropane in an aromatic solvent and 25% of a 50 wt. % solution of the polymeric reaction product of epichlorohydrin and oleyl amine in an aromatic solvent. Test C was run using 600 cc. of gasoline containing 34 ppm. of the additive used in Test B plus 4 ppm. of isopropyl alcohol. Test D was run with gasoline which contained 35 ppm. of the additive formulation of the present invention, namely, 70% by weight of a 50 wt. % solution of the polymeric reaction product of epichlorohydrin and N-tallow1,3-propanediamine in an aromatic solvent, 23% by weight of a 50 wt. % solution of the polymeric reaction product of epichlorohydrin and oleyl amine in an aromatic solvent, 5% by weight of isopropyl alcohol and 2% by weight of an oil demulsifier comprising a copolymer of ethylene oxide and propylene oxide. The results of these tests are set forth in Table I below:

TABLE I

| TEST | TOTAL $H_2O$, cc | % EMULSION | EMULSIBILITY RATING |
|---|---|---|---|
| A | 0 | 0 | 508 |
| B | 3.5 | 100 | 282.2 |
| C | 3.5 | 97 | 350.22 |
| D | 0.9 | 0 | 538 |

It will be noted from the above comparative tests that the gasoline sample which contained the additive formulation of the present invention approached the values of the blank gasoline, that is, practically no water came over as compared to the 3.5 cc. of water which came over with the additives used in Tests B and C. Likewise, there was no emulsion found in the gasoline which contained the additive formulation of the present invention and, in addition, the emulsibility rating of the gasoline with additive formulation of the present invention was higher than that of the blank gasoline. This contrasted again with the emulsion percentage of the gasolines containing the additives of Tests B and C as well as a lower emulsibility rating of these two samples.

EXAMPLE II

As a further illustration of the ability of the additive formulation of the present invention to impart desirable characteristics to petroleum distillates, a carburetor icing test was performed in which both regular and premium type gasoline were evaluated with and without the additive formulation of the present invention.

The anti-icing properties were determined in a carburetor icing demonstration apparatus consisting of a vacuum pump equipped so that cool moisture-saturated air from an ice tower is drawn through a simulated carburetor. The gasoline sample passes from a fuel reservoir through a flow meter into the carburetor at a rate of 1.4 lb/hr. The air from the ice tower is passed at a flow rate of 14.4 lb/hr at a temperature of 40° F. In addition, the manifold vacuum is 9.5 inches of mercury at the start and 12.5 at the end of the test. Evaporation of the gasoline in the carburetor further cools the cold moist air, with resulting ice formation on the throttle plate. The time in seconds is measured until a drop of 3 inches of mercury vacuum occurs which indicates stalling conditions. The regular type gasoline which was used in this experiment reached stalling conditions within about 16.5 seconds. In contrast to this, when an additive formulation of the present invention consisting of 70% by weight of a 50 wt. % solution of the polymeric reaction product of epichlorohydrin and N-tallow-1,3-propanediamine in an aromatic solvent, 23% by weight of a 50 wt. % solution of the polymeric reaction product of epichlorohydrin and oleyl amine in an aromatic solvent, 5% by weight of isopropyl alcohol and 2% by weight of an oil demulsifier comprising a copolymer of ethylene oxide and propylene oxide was added in concentrations of 10, 30 and 50 ppm. of gasoline, the stalling times were 23.2, 31.6 and 44.1 seconds respectively.

Likewise when commercial premium grade gasoline was evaluated in like manner, it was found that the stalling time of the premium grade gasoline which contained no additive was 24.7 seconds while the stalling time of the premium base gasoline with 10 ppm. of the additive formulation described above increased to 34.6 seconds.

It is thus readily apparent that the addition of the additive formulation of the present invention was effective in increasing the icing time of both regular base and premium base gasoline.

EXAMPLE III

As an additional example of the ability of an additive formulation of the present invention to afford desirable characteristics to petroleum distillates, an additive having the formulation as set forth in Examples I and II above was utilized in a carburetor detergency test. Again the additive formulation was used in connection with both regular base and premium base gasoline. The blank fuels afforded very dirty carburetor throat bodies after the standard 5-hour test cycle. In contradistinction to this, the additive formulation, when added to both regular base and premium base gasolines in concentrations of 30 and 50 ppm., were effective in keeping these deposits to a low level at the 30 ppm. dosage level and keeping the area of the carburetor clean at the 50 ppm. dosage level. A summary of these tests is set forth in Table II below:

TABLE II

| Fuel Type | Additive | Concentration (ppm) | % Reduction in Deposits (Keep Clean) Upper | | Lower |
|---|---|---|---|---|---|
| Regular | None | | | Very Dirty | |
| | Additive A* | 30 | 25 | | 35 |
| | | 50 | 35 | | 25 |
| Premium | None | | | Very Dirty | |
| | Additive A* | 30 | 35 | | 25 |
| | | 50 | 80 | | 75 |

*Additive A is 70% by weight of a 50 wt. % solution of the polymeric reaction product of epichlorohydrin and N-tallow-1,3-propanediamine in an aromatic solvent, 23% by weight of a 50 wt. % solution of the polymeric reaction product of epichlorohydrin and oleyl amine in an aromatic solvent, 5% by weight of isopropyl alcohol and 2% by weight of an oil demulsifier comprising a copolymer of ethylene oxide and propylene oxide.

The results set forth in Table II above clearly illustrate the ability of the additive formulation of the present invention to reduce deposits on the throttle plate of a carburetor which tend to build up when using gasoline which does not contain the aforesaid additive formulation.

EXAMPLE IV

In this example an additive formulation is prepared by thoroughly admixing 70% by weight of a solution of the polymeric reaction product of an epichlorohydrin and N-soya-1,3-propanediamine in an aromatic solvent, 23% by weight of a solution of the polymeric reaction product of epichlorohydrin and hydrogenated tallow amine in an aromatic solvent, 5% by weight of ethyl alcohol and 2% by weight of an oil demulsifier comprising a copolymer of ethylene oxide and propylene oxide, said copolymer having a molecular weight of about 4,000. The formulation is utilized as an additive for gasoline and is subjected to water emulsibility, anti-icing and carburetor detergency tests similar to that set forth in Examples I through III above. It will be determined that this additive formulation will impart desirable characteristics to the gasoline similar in nature to the characteristics which were imparted to gasoline, both regular base and premium base, when the additive formulation of Examples I through III was used.

EXAMPLE V

In addition to the tests which were performed utilizing the additive formulation of the present invention, it was also used in a stability test to illustrate the activity of the formulation as a fuel oil stabilizer. The one-day fuel oil stability test which was used consisted in filtering the fuel oil through coarse filter paper to remove any sediment or emulsion which may have been present. Following this, 1 liter of the fuel oil was measured into a flask containing 4 mild cold-rolled steel strips 5 × ½ × 1/16 inches in size which had been sand blasted and rinsed with a solvent. In one flask 10 ppm. of an additive formulation of the type set forth in Example I above were added to the fuel oil and the two flasks were swirled to thoroughly admix the mixture. An oxygen line was then placed in the flask and the air space was purged with oxygen for a period of 5 minutes. Following this, a Teflon sleeve was placed on the stopper of the flask, the flask was stoppered and the stopper was secured with steel springs. The flasks were then placed in an oil bath for a period of 16 hours while maintaining the temperature of the bath at 212° F. At the end of the 16 hours, the flasks were removed from the bath and allowed to return to room temperature for a period of 1 hour. An AA Millicore filter disc was weighed in a Petri dish. The fuel oil was then filtered through the disc into a clean suction flask, using a soft vacuum at the start of the filtration to avoid any possible damage to the filter. Upon completion of the filtration, a portion of the filtered oil was removed for a color determination. The flask and iron strips were then rinsed three times with 100 cc. portions of solvent, said solvent being also filtered through the filter. The filter was then rinsed with a small amount of additional solvent to insure that all of the oil was washed through the filter. Thereafter the filter was suction dried by an additional vacuum treatment.

The filter was then removed and placed in the same Petri dish in which it had previously been weighed. The filter was then baked in an oven for 1 hour at a temperature of 95° C., following which the dish was removed, cooled in a dessicator for a period of 16 hours and reweighed. The net gain in weight was calculated as milligrams of sediment per liter. The total sediment which is formed is taken as an important criterion of fuel oil stability due to the fact that it correlates roughly with field performance.

The stability test hereinbefore described was utilized with two separate fuel oils. The characteristics of these fuels are set forth in the following table.

| Characteristics | Fuel 1 | Fuel 2 |
|---|---|---|
| Gravity, API 60° F. | 32.8 (0.8612) | 30.8 (0.8718) |
| Flash, PMCC, °F | 178 | 168 |
| Color, ASTM D-1500 | 0.5 | <1.0 |
| Cloud Point, ASTM D-2500 | 5 | −2 |
| Pour Point, ASTM D-97 | 0 | −15 |
| Viscosity, Kin CS at 100° F. | 2.88 | 3.35 |
| Saybolt Color | — | — |
| Dist. ASTM D-87 | | |
| IBP° | 370 | 373 |
| 10% | 447 | 456 |
| 50% | 524 | 539 |
| 90% | 586 | 610 |
| EP° F | 620 | 642 |
| Total Sulfur, wt-% | 0.258 | 0.226 |
| Mercaptan Sulfur, wt-% | 0.0021 | 0.0003 |
| Hydrogen Sulfide, wt-% | <0.0001 | <0.0001 |
| Total Nitrogen, ppm | 64±1 | 105±1 |
| Acid No., mg KOH/gm | <0.001 | |
| Alkali extractable Phenols, by UV/ppm | 175 | 510 |
| Alkali extractable Thiophenol by UV/ppm | <10 | 40 |
| Copper by AAS, ppb | 15 | <10 |
| Photo Color | 93.0 | 93.0 |
| Color ASTM D-1500 converted | ½ | ½ |
| Sediment, mg/100 ml | | 0.5 |

The results of the two tests utilizing, as hereinbefore set forth, 10 ppm. of the additive formulation of Example I above, is as follows:

ONE-DAY FUEL OIL STABILITY TEST

| Fuel | Additive (at 10 ppm.) | ASTM Color | Sediment mg/100 ml |
|---|---|---|---|
| 1 | None | 1 | 0.3 |
| 1 | A | 1 | 0.1 |
| 2 | None | 1 | 0.3 |
| 2 | A | 1 | 0.1 |

A = Additive formulation of Example I

It is readily apparent from the above data that the fuel oils containing the additive formulation retarded the tendency of the oils to form sediment and, in addition, maintained the color of the oil in an acceptable form.

EXAMPLE VI

To illustrate the corrosion protection activity of the additive formulations of the present invention, another test is performed in which an iron strip has one surface thereof freshly polished. The iron strip is placed with the polished side up on the bottom of an 800 ml beaker which contains 500 ml of fuel oil in order to prewet the surface. The 500 ml of fuel oil is transferred to a Waring blender and mixed with 5,000 ppm. of distilled water for 1 minute. The resulting hazed fuel is returned to the beaker which is thereafter covered with a glass. After a 24-hour period of settling, the iron strip is examined for rust and the percentage of the surface covered by rust is determined. The test is repeated after aging the fuel oil at 110° F. for a period of 6 weeks and again after 18 weeks. When the additive formulation of the present invention is admixed with fuel oil in an amount of 10 ppm. it will be found that the freshly polished surface of the iron strip will have a smaller area of rust than will the iron strip which has been immersed in a fuel oil which does not contain the additive.

I claim as my invention:

1. An additive formulation for petroleum distillates which comprises from about 50% to about 90% by weight of a solution of the polymeric reaction product of an epihalohydrin and an N-alkylpolyamine in which the alkyl group contains at least 12 carbon atoms, from about 10% to about 50% by weight of a solution of the polymeric reaction product of an epihalohydrin and a primary alkylamine in which the alkyl portion contains at least 12 carbon atoms, from about 1% to about 10% by weight of an alcohol of from 1 to 5 carbon atoms, and from about 1% to about 10% by weight of a copolymer of ethylene oxide and propylene oxide.

2. The additive formulation of claim 1 in which said epihalohydrin is epichlorohydrin.

3. The additive formulation of claim 2 in which said N-alkylpolyamine is N-tallow-1,3-propanediamine.

4. The additive formulation of claim 2 in which said N-alkylpolyamine is N-soya-1,3-propanediamine.

5. The additive formulation of claim 2 in which said primary amine is hydrogenated tallow amine.

6. The additive formulation of claim 2 in which said primary amine is oleyl amine.

7. The additive formulation of claim 2 in which said N-alkylpolyamine is N-tallow-1,3-diaminopropane and said primary alkylamine is oleyl amine.

8. The additive formulation of claim 1 in which said alcohol is ethyl alcohol.

9. The additive formulation of claim 1 in which said alcohol is isopropyl alcohol.

10. Petroleum distillate containing from about 25 to about 1,000 ppm. by weight of the addition formulation of claim 1.

11. The composition of claim 10 in which said petroleum distillate is gasoline.

12. The composition of claim 10 in which said petroleum distillate is a distillate fuel oil.

* * * * *